US010648211B2

(12) United States Patent
Gorenbacher

(10) Patent No.: US 10,648,211 B2
(45) Date of Patent: May 12, 2020

(54) DOOR ASSEMBLY AND HINGE THEREFOR

(71) Applicant: SIMONSWERK GmbH, Rheda-Wiedenbrueck (DE)

(72) Inventor: Sergei Gorenbacher, Rheda-Wiedenbrueck (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 158 days.

(21) Appl. No.: 15/861,185

(22) Filed: Jan. 3, 2018

(65) Prior Publication Data

US 2018/0195328 A1 Jul. 12, 2018

(30) Foreign Application Priority Data

Jan. 9, 2017 (DE) ..... 10 2017 100 270

(51) Int. Cl.

| | |
|---|---|
| ***E05D 3/06*** | (2006.01) |
| ***E05D 7/04*** | (2006.01) |
| ***E05D 11/06*** | (2006.01) |
| ***E05D 5/02*** | (2006.01) |
| ***E05D 5/08*** | (2006.01) |
| ***E05D 3/14*** | (2006.01) |

(52) U.S. Cl.

CPC ..... *E05D 7/0407* (2013.01); *E05D 3/14* (2013.01); *E05D 3/142* (2013.01); *E05D 5/0246* (2013.01); *E05D 5/08* (2013.01); *E05D 7/0415* (2013.01); *E05D 11/06* (2013.01); *E05Y 2600/41* (2013.01); *E05Y 2900/132* (2013.01); *E05Y 2900/20* (2013.01); *E05Y 2900/202* (2013.01)

(58) Field of Classification Search

CPC ..... E05D 7/0407; E05D 3/14; E05D 5/08; E05D 5/0246; E05Y 2900/132; E05Y 2900/202; E05Y 2900/20

USPC ..... 16/237, 238, 239, 240, 242, 245, 337, 16/338, 270, 366, 368, 369, 370

See application file for complete search history.

(56) References Cited

U.S. PATENT DOCUMENTS

| | | | | |
|---|---|---|---|---|
| 882,721 A * | 3/1908 | Soss | E05F 3/20 | 16/68 |
| 1,484,093 A * | 2/1924 | Soss | E05D 3/186 | 16/358 |
| 1,772,559 A * | 8/1930 | Soss | E05D 3/14 | 16/357 |

(Continued)

FOREIGN PATENT DOCUMENTS

| | | |
|---|---|---|
| DE | 4341422 B | 6/1995 |
| DE | 202014102793 U | 8/2014 |

(Continued)

*Primary Examiner* — Jerry E Redman
(74) *Attorney, Agent, or Firm* — Andrew Wilford

(57) ABSTRACT

A hinge mountable between a door jamb and an edge of a door panel has a jamb part set in the jamb, and a panel part fixed to the panel. A first link has one end pivoted at a first jamb axis in the jamb part and an opposite end pivoted at a first panel axis in the panel part, and a second link has one end pivoted at a second jamb axis in the jamb part offset from the first jamb axis and an opposite end pivoted at a second panel axis in the panel part. The axes all are substantially parallel and offset horizontally from one another. The two links are not connected directly to one another between their ends. The first and second links are U-shaped in a central section between their ends.

14 Claims, 7 Drawing Sheets

(56) References Cited

U.S. PATENT DOCUMENTS 2,100,928 A * 11/1937 Way ..... E05D 3/186 16/358
2,178,271 A * 10/1939 Soss ..... E05D 3/186 16/358
2,570,479 A 10/1951 Pollman
2,694,216 A * 11/1954 Schnur ..... E05D 3/16 16/369
3,619,853 A * 11/1971 Merrill ..... E05D 3/12 16/366
4,083,082 A 4/1978 Holmes
4,928,350 A * 5/1990 Morgan ..... E05D 3/12 16/297
5,561,887 A * 10/1996 Neag ..... E05D 3/127 16/334
5,685,046 A * 11/1997 Neag ..... E05D 3/127 16/366
6,487,755 B1 * 12/2002 Caldari ..... E05D 3/186 16/287
6,629,337 B2 * 10/2003 Nania ..... E05D 3/127 16/334
6,647,592 B2 * 11/2003 Presley ..... E05D 3/145 16/288
6,829,808 B2 * 12/2004 Neukotter ..... E05D 3/186 16/366
6,913,308 B2 * 7/2005 Azzouz ..... B60J 5/0479 296/146.1
6,938,303 B2 * 9/2005 Watson ..... E05D 3/127 16/247
6,942,277 B2 * 9/2005 Rangnekar ..... E05D 3/127 16/366
7,096,535 B2 * 8/2006 Lin ..... E05D 11/1021 16/286
7,096,538 B2 * 8/2006 Liang ..... E05D 3/127 16/287
7,861,378 B2 * 1/2011 Neukotter ..... E05D 3/06 16/237
7,950,109 B2 * 5/2011 Elliott ..... E05D 3/127 16/334
7,980,621 B2 * 7/2011 Elliott ..... E05C 17/203 296/146.12
8,434,197 B2 * 5/2013 Oshima ..... E05D 3/186 16/241
8,651,556 B2 2/2014 Cutting
8,745,824 B2 * 6/2014 Holstensson ..... E05D 3/12 16/224
8,863,361 B2 * 10/2014 Neukoetter ..... E05D 3/186 16/366
9,523,225 B2 * 12/2016 Smith ..... E05D 3/147
9,803,410 B2 * 10/2017 Miglioranzo ..... E05D 3/186
9,976,327 B2 * 5/2018 Dreisewerd ..... E05D 3/18
10,100,970 B1 * 10/2018 Wu ..... F16M 13/005
2004/0139580 A1 * 7/2004 Hiramatsu ..... E05D 3/12 16/366
2007/0294860 A1 * 12/2007 Hoffman ..... E05D 3/186 16/368
2010/0115729 A1 * 5/2010 Neukoetter ..... E05D 3/186 16/235
2010/0122431 A1 * 5/2010 Neukoetter ..... E05D 3/186 16/238
2012/0180396 A1 * 7/2012 Liermann ..... E05D 3/186 49/398
2012/0291222 A1 * 11/2012 Liermann ..... E05D 7/04 16/237
2012/0291225 A1 * 11/2012 Liermann ..... E05D 3/186 16/364
2015/0031224 A1 * 1/2015 Dreisewerd ..... E05D 3/186 439/165
2017/0030120 A1 * 2/2017 Dreisewerd ..... E05D 7/0423
2017/0234046 A1 * 8/2017 Shepherd ..... E05D 3/14 16/370

FOREIGN PATENT DOCUMENTS

DE 202014103324 A 11/2015
EP 1374976 A 1/2004

* cited by examiner

DOOR ASSEMBLY AND HINGE THEREFOR

FIELD OF THE INVENTION

The present invention relates to a door hinge. More particularly this invention concerns a door assembly using such a hinge.

BACKGROUND OF THE INVENTION

A known hinge has a door-jamb part and a door-panel part joined to one another by a first hinge link and a second hinge link, and the hinge has an opening angle of at least 135°, starting from a closed position until reaching a maximum open position. During movement into the open position from the closed position the hinge link rotates with respect to the door jamb part in a first direction of rotation, and the door panel part also rotates in the first direction of rotation with respect to the hinge link. The hinge links form a four-axis joint in which the first hinge link is attached to the jamb part so that it can rotate about a first jamb axis and is attached to the panel part so that it can rotate about a first panel axis. Meanwhile the second hinge link is attached rotatably to the jamb part so that it can rotate about a second jamb axis and is attached to the panel part, so that it can rotate about a second panel axis, and the two hinge links are not connected directly to one another, and there are no link guides.

Various hinge constructions are known from practice for various intended uses. The present invention however relates specifically to a hinge designed for use on house doors and room doors. The hinge must thus be able to absorb the lever forces and weight forces exerted by a door panel. A corresponding door panel usually has an area of at least one square meter and weighs at least 10 kg.

When such a door is used to close closuring a passage, considerable loads occur due to this use, in particular since the door is operated from both sides and is visible from both sides.

Against this background, the hinge must have an adequate stability on the one hand and on the other hand an unremarkable appearance of the hinge is required so that the door formed from a door panel, a door jamb and, in most cases, at least two hinges fits well into the surrounding wall surface and has a high-quality appearance.

The invention relates in particular to hinges arranged, so that they are at least partially recessed, and the jamb part is provided for being recessed into the part of the door jamb covered by the door when closed.

U.S. Pat. No. 9,523,225 describes a generic hinge used in the form of a concealed hinge for vehicle doors in particular.

A similar hinge is also known from U.S. Pat. No. 6,829,808. The hinge here is inserted as a concealed hinge into the edge of a door panel and the confronting surface of a door jamb and is not visible when the door is closed. The two hinge links can each rotate about a vertical axis of rotation on their ends and on their other end are guided, so that they are longitudinally displaceable and rotatable. In addition, the two hinge links are connected to one another at center sections connecting the ends so they rotate about another vertical axis of rotation. The result is thus a five-axis joint configuration in which two of the joint axes are also guided along connecting links.

These hinge are characterized by a stable construction and good noise properties. The guides on the panel part and on the jamb part must be of an adequate size, so that a robust door frame and door panel must be used.

DE 43 41 422 describes a cup hinge for furniture with a four-axis joint construction. The cup hinge attaches a door to a carcase by its frame part. Since the interior of the furniture body is concealed in the case of a closed furniture door, the body part can be surface mounted and visible. The four-axis joint configuration is intended for shifting the door panel first away from the furniture body to a sufficient extent with an opening movement of the panel before it door is brought to the maximum open position by further rotation. The opening angle is typically about 90°. Starting from the body part the two hinge links rotate in a first direction of rotation while then a jamb part of the pressure hinge is rotated in a second direction of rotation in comparison with the hinge links in the opposite direction. With regard to the respective reference points, the result is thus rotation in the opposite direction, so that the opening angle of the furniture door remains limited to about 90°.

OBJECTS OF THE INVENTION

It is therefore an object of the present invention to provide an improved door assembly and hinge.

Another object is the provision of such an improved door assembly and hinge that overcomes the above-given disadvantages, in particular that is especially compact and is suitable in particular for doors with a panel of glass.

SUMMARY OF THE INVENTION

A hinge mountable between a door jamb and an edge of a door panel has according to the invention a jamb part set in the jamb, and a panel part fixed to the panel. A first link has one end pivoted at a first jamb axis in the jamb part and an opposite end pivoted at a first panel axis in the panel part, and a second link has one end pivoted at a second jamb axis in the jamb part offset from the first jamb axis and an opposite end pivoted at a second panel axis in the panel part. The axes all are substantially parallel and offset horizontally from one another such that the hinge can move from a closed position through an opening angle of at least 135° to a maximum open position with, during such opening from the closed position to the open position, the first and second links rotating in a first direction of rotation with respect to the jamb part and the panel part also rotating in the first direction of rotation with respect to the links. The two links are not connected directly to one another between their ends. The first and second links are U-shaped in a central section between their ends, so that for the first link, starting from a first connecting line between the first panel axis and the first jamb axis, a greatest distance, which is determined perpendicular to the first connecting line up to the center section, amounts to at least 0.5 times a distance between the first jamb axis and the first panel axis, and, starting from a second connecting line between the second panel axis and the second jamb axis, for the second link. The greatest distance, determined perpendicular to the second connecting line up to the center section, amounts to at least 0.5 times the distance between the second jamb axis and the second panel axis.

In contrast with a four-axis hinge arrangement known from use in furniture, the two hinge links with the hinge according to the invention are accommodated on the panel part and on the jamb part around the respective jamb axes and/or panel axes, so that the hinge links can rotate in a first direction of rotation with respect to the jamb part and the panel part can also rotate in the first direction of rotation with respect to the hinge links. In a simplified consideration, the pivot angles resulting from the hinge links on the one hand with respect to the jamb part and on the other hand with respect to the panel part are added up, so that an opening angle of at least 135° which is provided for the door can be achieved at the maximum open position. The opening angle until reaching the maximum open position is preferably between 170° and 185°, in particular about 180°. In the context of such an embodiment, the door panel can be pivoted out completely, so that the door panel then runs again parallel to the wall surface which is connected laterally to the door jamb on the hinge side.

In order to achieve such a large opening angle with the most compact possible design, the hinge links are of U-shape. The first and second hinge links here are each connected at their ends to the axis of the jamb part and the axis of the door panel part and are U-shaped in a central section between their ends.

The play in movement of the hinge links is greatly restricted in the case of a U-shape that is only slightly pronounced. To evaluate the characteristic of the U-shape, the distance between the two ends can be compared with the depth resulting at the center section for each of the two hinge links.

According to a suitable geometric definition, the greatest distance perpendicular to the first connecting line to the center section amounts to at least 0.5 times the distance between the first jamb axis and the first panel axis for the first hinge link, starting from the first connecting line between the first panel axis and the first jamb axis. Accordingly, for the second hinge link, starting from a second connecting line between the second panel axis and the second jamb axis, the greatest distance perpendicular to the second connecting line up to the center section amounts to at least 0.5 times the distance between the second jamb axis and the second panel axis.

The greatest distance perpendicular to the respective panel axis is to be determined up to the surface of the hinge link, i.e. to a certain extent up to the inside of the U-shape. Because of the U-shape, the hinge links are first guided away from the fastening axes, i.e. the jamb axes and the panel axes, starting from their ends.

To stabilize the four-axis joint configuration in the closed position and/or at the maximum open position, according to a preferred embodiment of the invention, at least one of the hinge links abuts against a stop face of the jamb part and/or of the panel part in the closed position and/or in the open position. For example, in the maximum open position, the first hinge link may abut against a first stop face of the panel part, whereas in the closed position the second hinge link may abut against a second stop face of the panel part.

In the closed position, the panel part and the jamb part are preferably arranged side by side in a first horizontal direction, wherein when the door is closed the door panel also runs with its two opposing outside surfaces along the first horizontal direction. The first jamb axis and the second jamb axis are then arranged with an offset from one another along the first horizontal direction, wherein there is little or no offset perpendicular thereto in a second horizontal direction.

A second horizontal direction corresponds to the horizontal thickness perpendicular to the plane of the normally vertical door panel. The first panel axis and the second panel axis are offset from one another along the second horizontal direction, and either little or no offset is then preferably provided along the first horizontal direction x with respect to the first panel axis and the second panel axis.

As already explained in the introduction, the hinge is preferably provided for a door panel made of glass. To this end the panel part may have a clamping arrangement for accommodating the door panel. A door panel in the form of a sufficiently stable pane of glass can then be attached easily with a clamping effect to the panel part without having to form additional passages, openings or connections in the door panel. Such a clamping or gripping arrangement also enables positioning of the door panel in the door jamb after being released, so that the door jamb can be adjusted along the first horizontal direction as well as a vertical direction. The clamping arrangement is preferably provided with at least one section running obliquely. In this way the clamping force can be additionally increased under load.

The subject matter of the invention is also a door assembly having a door jamb, a door panel and a hinge as described previously. The door panel is usually attached to the door jamb with at least two hinges that may be identical. The following discussion therefore refers as an example to the arrangement of one of several hinges on the room door.

In the closed position of the hinge, the door jamb has a front face aligned in parallel with the door panel and an inner face running perpendicular thereto and connected laterally to the door panel, wherein the inner face has a first offset face, starting from the front face and a second face connected thereto by an inwardly directed step.

The front face thus extends along the first horizontal direction and the vertical direction, while the face—except for the offset along the first horizontal direction at the step—extends along the second horizontal direction and the vertical direction. The step here preferably forms the stop for the door panel, wherein a traditional door gasket may also be arranged on the step.

The jamb part is preferably fitted into a recess in the inner face, so that the jamb part is at least partially recessed. In particular the recess may extend from the first offset face to the second face, so that then the region of the step may also be used for seating the jamb part.

According to a preferred refinement, a separate cover can be mounted on the jamb part has a step corresponding to the shape of the inner face, so that a first end tab of the cover is connected at least essentially flush to the surface to the first offset face, and a second end tab is connected at least essentially, so that it is flush with the surface on the second face.

To permit an adaptation to different frame shapes, different covers and/or adjustable cover may optionally be provided. To permit a compact design of the hinge, according to one refinement of the invention, a cutout extending away from the inner face in the area of the hinge may be provided in the front face. The hinge links can then pivot into this cutout with an opening movement.

In such an embodiment, a part of the cutout may also be filled by a cover link arranged on the jamb part of the hinge as a refinement to further stabilize the edge of the cutout and in particular to act as a support for a screen on the panel part.

When the jamb part is inserted into the inner face as described above and the front face also has a cutout, starting from the inner face in the area of the hinge, the result is not a uniformly continuous gap. Above and below the hinge, there remains a lateral gap between the door panel and the first offset face, but in particular in the case of an embodiment of the door panel made of glass, the panel part is situated laterally on the door panel in this gap region. It is then advantageous for the panel part to be covered with a screen, so that a gap is no longer present in the area of the hinge.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
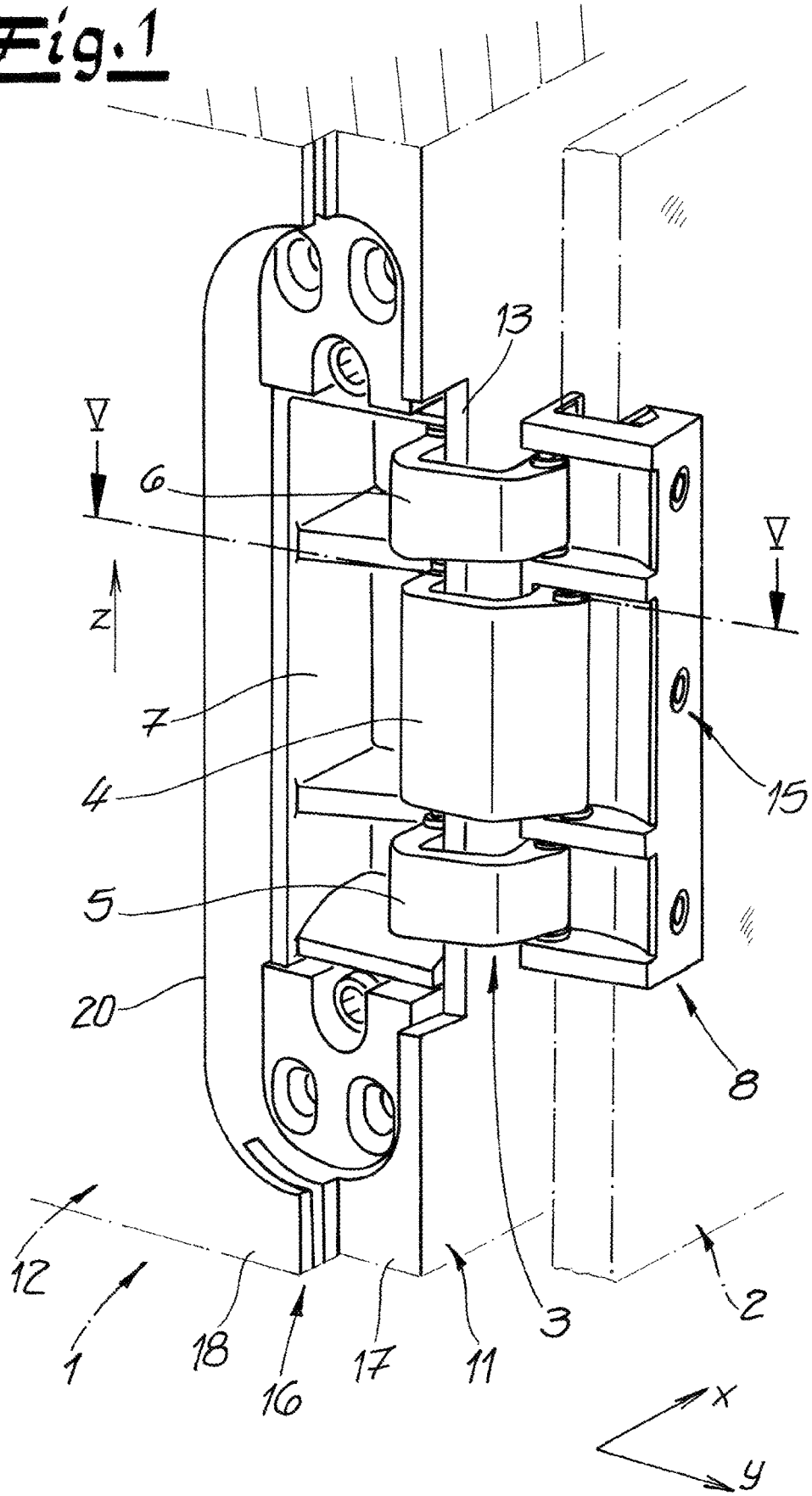
FIG. 1 is a large-scale perspective view of the door assembly and hinge according to the invention in the fully open position.
Figure 2:
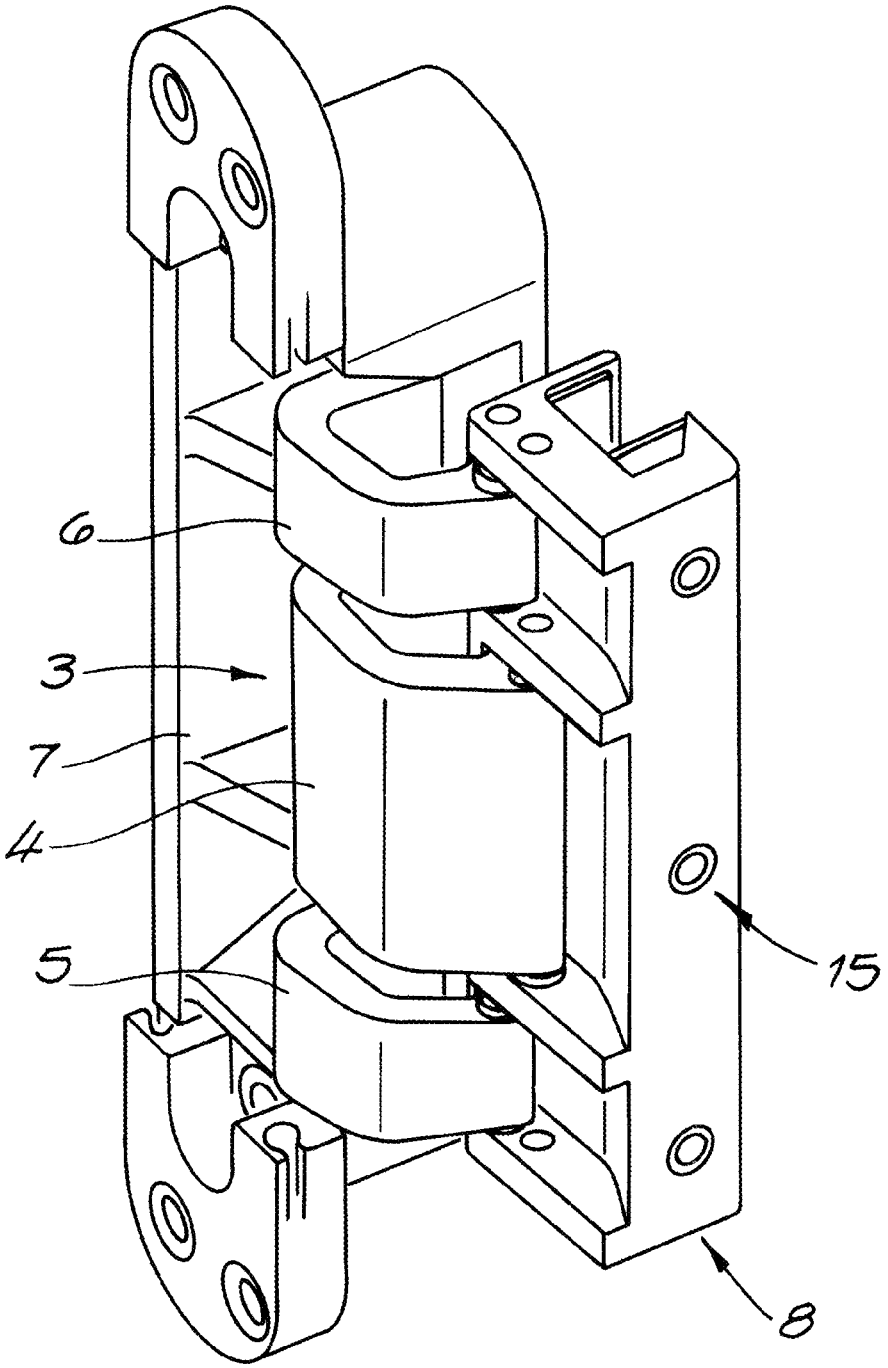
FIG. 2 is a view like FIG. 1, but showing only the hinge.
Figure 3:
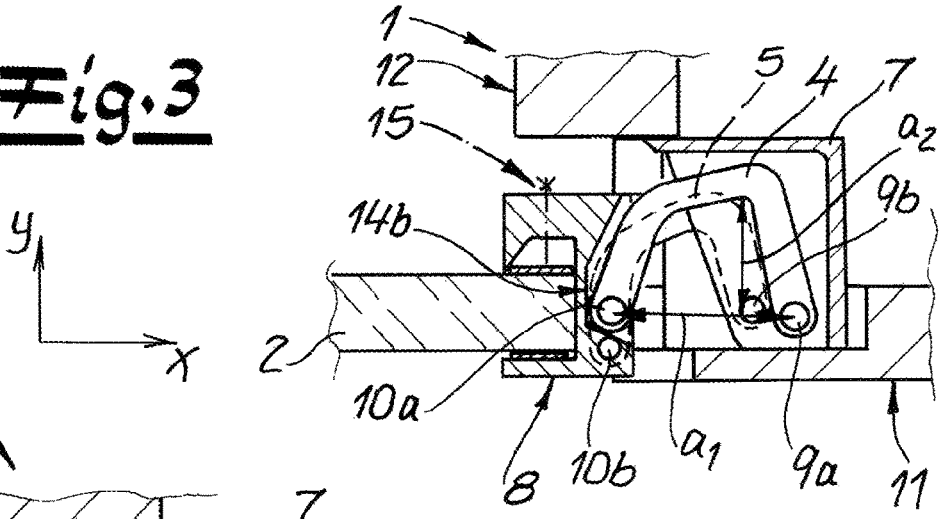
FIGS. 3, 4, and 5 are horizontal sections along the line V-V of FIG. 1 in the closed, half open, and fully open positions, respectively.
Figure 4:
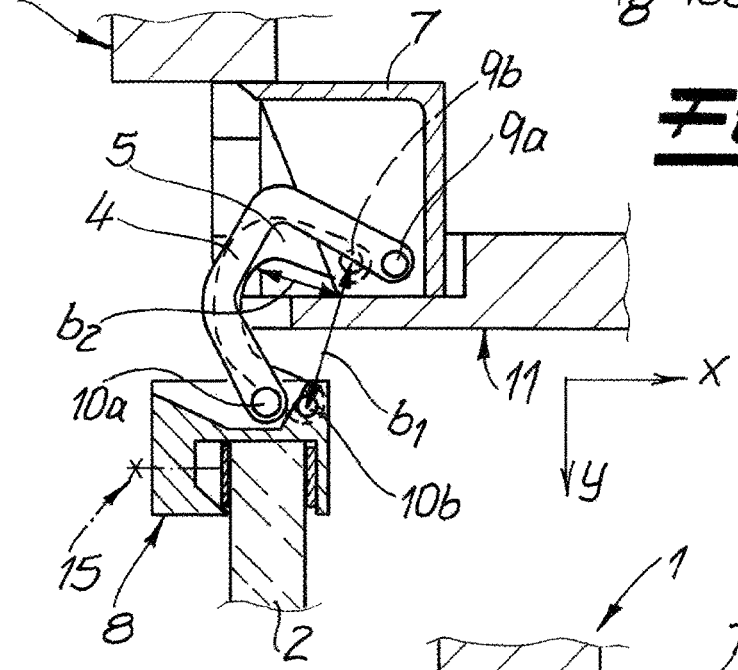
Figure 5:
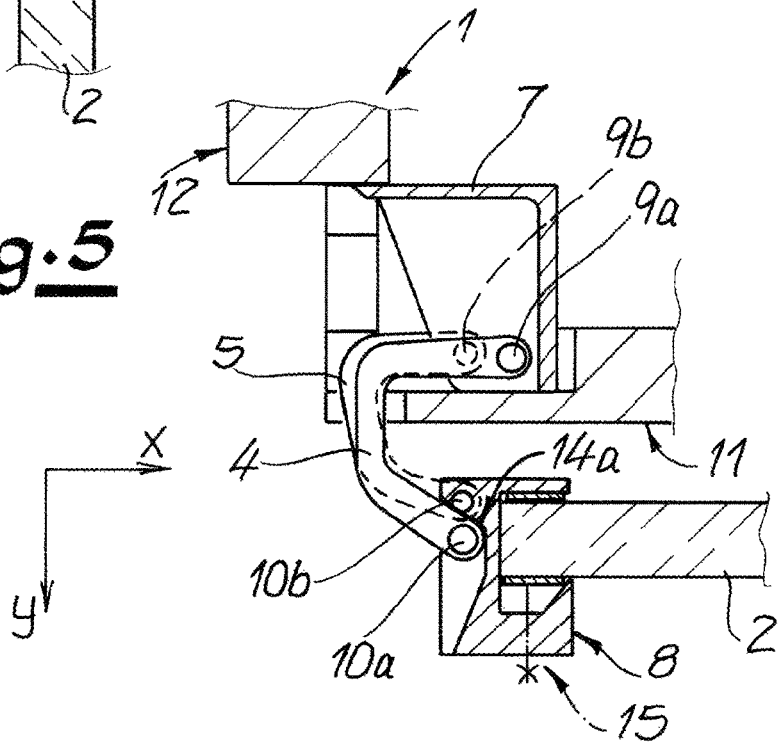

As seen in FIG. 1 a room door has a door jamb or frame 1, a door panel 2 and a hinge 3. The door panel 2 is usually supported on the door jamb 1 by at least two identical hinges 3, of which one is shown in FIG. 1. FIG. 1 and the horizontal sections according to FIGS. 3 to 5 show that the hinge has a four-axle configuration. In concrete terms the hinge 3 has a first hinge link 4 that is between but a vertical direction Z between a second hinge link 5 and a third hinge link 6.

The second hinge link 5 and the third hinge link 6 are identical and are also connected to a jamb part 7 and a panel part 8 of the hinge 3 similarly, so that they can rotate. The second hinge and third links 5 and 6 move and operate identically. An embodiment having only one first hinge link 4 and one second hinge link 5 is basically sufficient and within the scope of the invention. The use of both the second hinge link 5 and the third hinge link 6, which is symmetrical with respect to the center plane, is for reasons of uniform force distribution and is shown here merely as an example.

FIG. 1 further shows that the hinge 3 has an opening angle of 180° at a maximum open position, starting from a closed position and in which the panel 2 is offset 180° from its position when fully closed.

The precise arrangement of the first hinge link 4 and the second hinge link 5 as well as the kinematics of the hinge 3 in an opening movement can be seen in FIGS. 3 to 5. Thus with the four-axle hinge configuration, the first hinge link 4 is attached to the jamb part 7 so that it can rotate about a first jamb axis 9*a* and is attached to the panel part 8, so that it can rotate about a first panel axis 10*a*. Similarly, the second hinge link 5 (and 6) is attached to the jamb part 7 so that it can rotate about a second jamb axis 9*b* in the jamb part 7 and is attached to the panel part 8 so that it can rotate about a second panel axis 10*b* relative thereto. The figures also show that all the hinge links 4, 5, 6 are not connected directly to one another. The only connection and support of the links 4, 5, and is at the jamb axes 9*a*, 9*b* and the panel axes 10*a*, 10*b* that are all vertical and parallel to one another.

The jamb axes 9*a*, 9*b* and the panel axes 10*a*, 10*b* are arranged in such a way that the door panel can be pivoted 180°. As shown in FIGS. 3 to 5, this is achieved by the fact that with an opening movement from the closed position to the open position, the hinge links 4, 5, 6 rotate in a first direction of rotation with respect to the jamb part 7, and the panel part 8 also rotates in the first direction with respect to the hinge links 4, 5, 6. The hinge links 4, 5, 6 meanwhile rotate counterclockwise with respect to the jamb part 7. In addition, the panel part 8 also rotates counterclockwise with respect to the hinge links 4, 5, 6, so that ultimately the angles of rotation are added to the opening angle to be achieved.

Figure 8A:
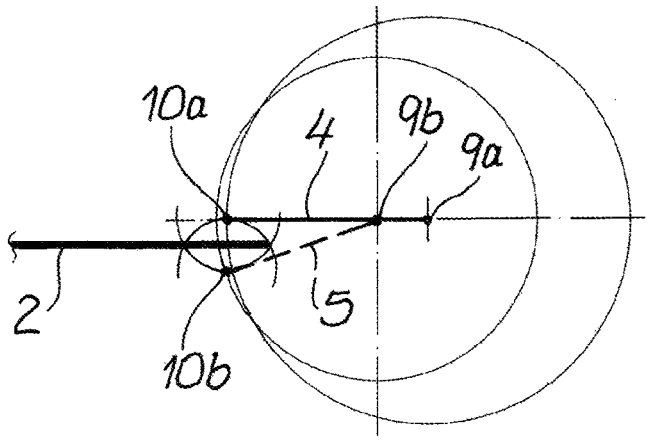
FIGS. 8A-8C are diagrams corresponding to respective FIGS. 3-5 and schematically illustrating the operation of the linkage of this invention.
Figure 8B:
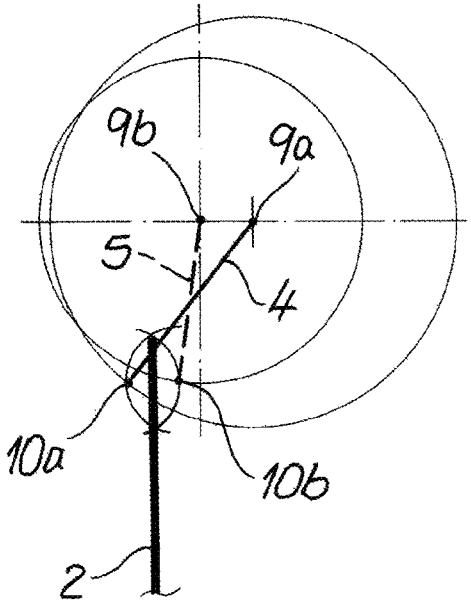
Figure 8C:
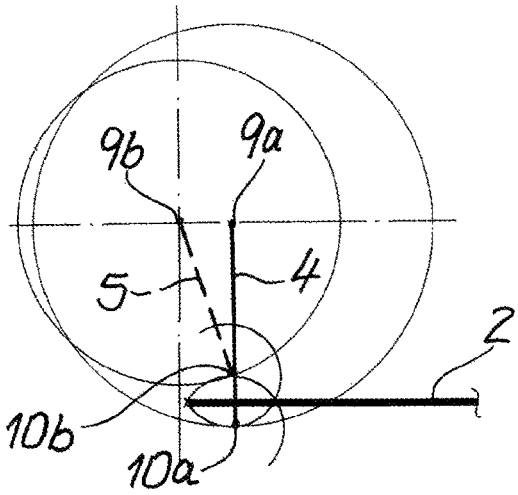

To illustrate the kinematics, FIGS. 8A through 8C show these movements in a highly schematized form in comparison with FIGS. 3-5, with only the jamb axes 9*a*, 9*b*, the panel axes 10*a*, 10*b* and the door panel 2 being illustrated.

Figure 9A:
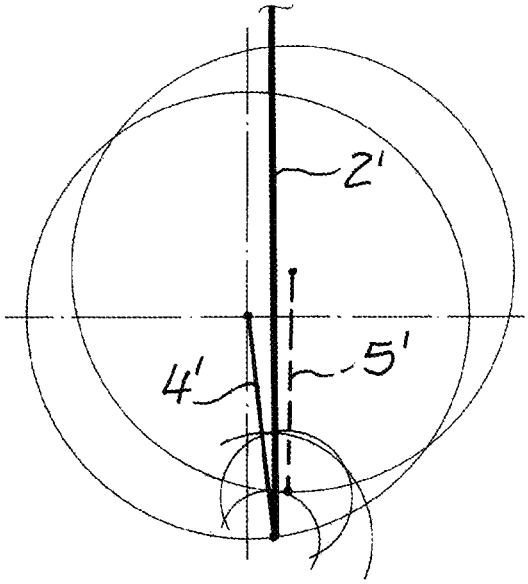
Fig. 9A Prior art
FIGS. 9A-9C illustrate the operation of a prior-art surface-mount hinge.
Figure 9B:
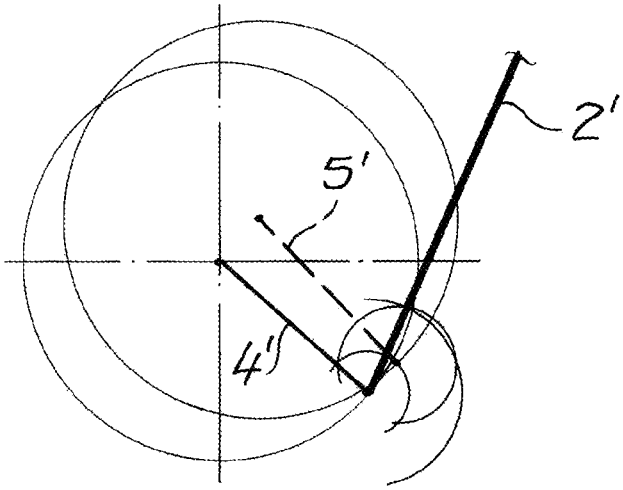
Fig. 9B Prior art
Figure 9C:
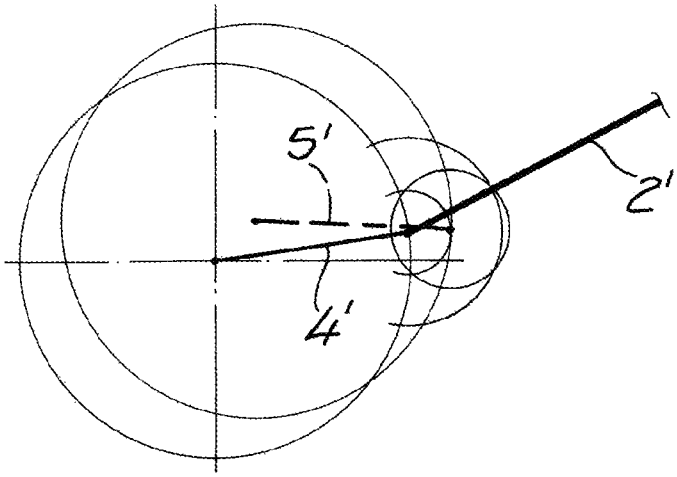
Fig. 9C Prior art

For comparison purposes, FIGS. 9A to 9C illustrate the kinematics of a prior-art cup hinge for furniture in which an opening angle of about 90° can be achieved by contrarotational movements.

FIGS. 3 to 5 also show that the hinge links 4, 5, 6 have a pronounced U-shape. According to FIG. 5 the U-shape allows the hinge links 4, 5, 6 to be pivotable about a front face 11 of the door jamb 1. In order to limit the depth of penetration of the jamb part 7 in a first horizontal direction X as well as a second horizontal direction Y, the front face 11 is provided with a cutout 13 explained in greater detail below, starting from an inner face 12 of the door jamb 1, the front and inner faces 11 and 12 being mutually perpendicular.

To characterize the size of the U-shape, the distance $a_1$ between the first jamb axis 9*a* and the second panel axis 10*a* can be determined by the fact that the maximum distance $a_2$ from a center section of the first hinge link 4 is determined perpendicular to a connecting line between the first jamb axis 9*a* and the first panel part 10*a*. The ratio of the distances $a_2$:$a_1$ preferably amounts to at least 0.5 within the scope of the invention.

Similarly, a distance $b_1$ can be determined for the second hinge link 5 between the second jamb axis 9*b* and the second panel axis 10*b* and perpendicular to that a distance $b_2$ can be determined, where, here again, the ratio $b_2$:$b_1$ is preferably greater than 0.5, that is $b_1$ is about twice $b_2$.

To stabilize the hinge 3 and to keep stress forces away from the jamb axes 9*a*, 9*b* as well as the panel axes 10*a*, 10*b*, at least one of the hinge links 4, 5, 6 may abut against a stop face 14*a* of the jamb part 7 or 14*b* of the panel part 8 in the closed position or in the open position. In the specific embodiment in the maximum open position according to FIG. 5, the first hinge link 4 abuts against the first stop face 14*a* of the panel part 8, whereas in the closed position the second hinge link 5 abuts against the second stop face 14*b* of the panel part 8 according to FIG. 3.

Due to the design of the hinge 3 according to the invention with the four-axle hinge configuration, the panel part 8 can be thin. At the side of the door panel 2 made of glass, only the first panel axis 10*a* and the second panel axis 10*b* have an offset in the second horizontal direction Y.

In addition, the panel part 8 comprises a clamping arrangement 15 with which the door panel 2 made of glass can be secured in a particularly simple way by clamping screws. When the clamping screws of the clamping arrangement 15 are loosened, the door panel 2 is also adjustable in the vertical direction Z and also to a certain extent along the first horizontal direction X. Additionally or alternatively, an adjustment in at least one direction X, Y, Z may also be provided on the jamb part 7.

According to FIG. 3, the first jamb axis 9*a* and the second jamb axis 9*b* are offset from one another along the first horizontal direction X.

Figure 6:
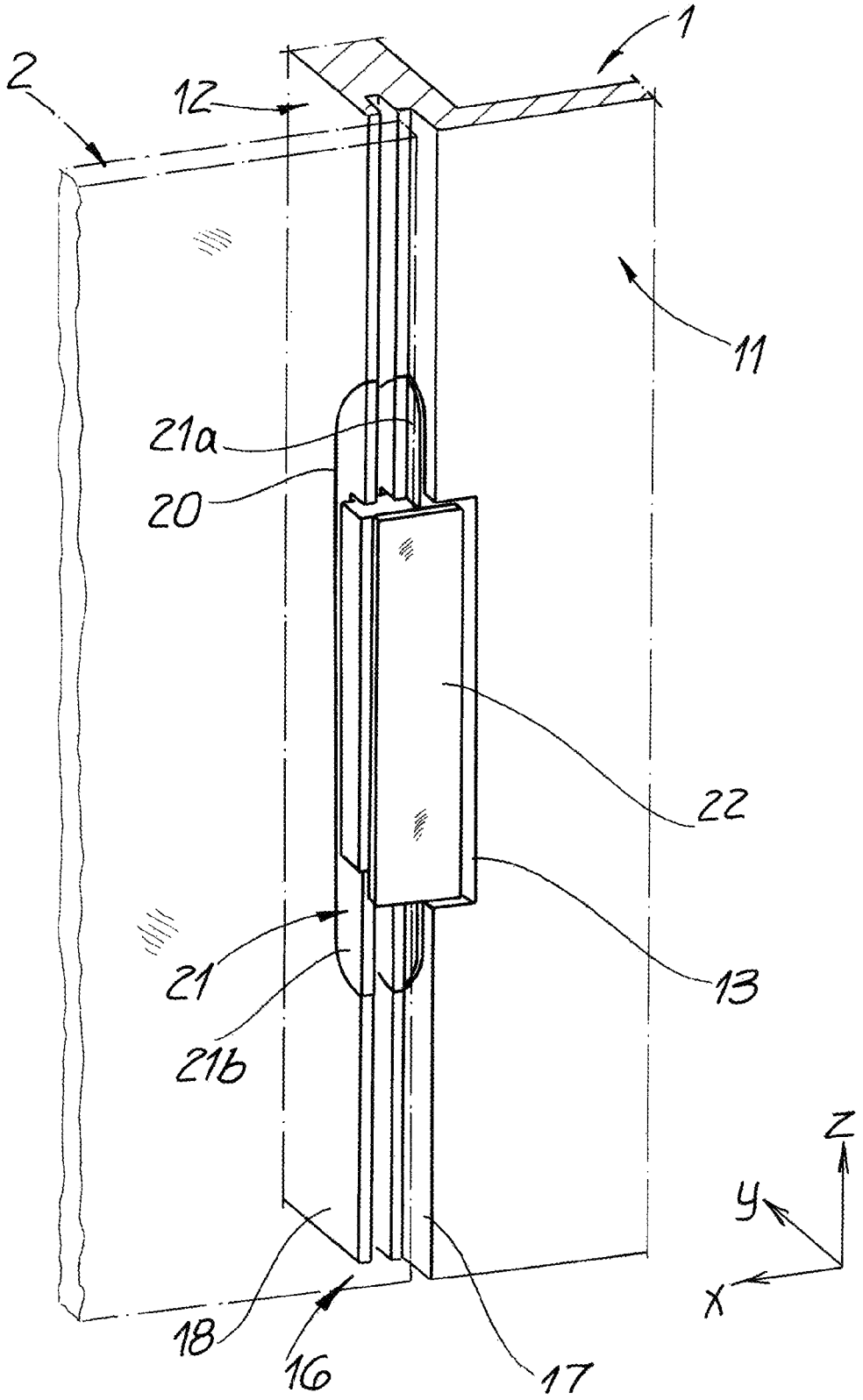
FIG. 6 is a perspective view of the assembly in the closed position.

FIG. 6 shows a detail of the door assembly illustrated in FIG. 1 when closed, and additional add-on parts are present in comparison with FIG. 1. Here the door jamb 1 has on the one hand the above-described front face 11 and inner face 12 running along the second horizontal direction Y as well as the vertical direction Z.

The inner face 12 is provided with a step 16 that separates a first offset face 17 connected to the front face 11 from a second face 18.

The step 16 forms a stop for the door panel 2 in a known manner, an unillustrated sealing groove holding a door gasket is also provided on the step 16.

A lateral gap remains above and below the hinge 3 between the door panel 2 and the first offset face 17. It can be seen in a comparison with FIG. 1 that the jamb part 7 is inserted into a recess 20 extending from the first offset face 17 into the second face 18 and thus beyond the step 16.

According to FIG. 1 the jamb part 7 is recessed behind the front face 11 from the outside within the recess 20 so that it is set back with respect to the inner face 12, and the jamb part 7 is covered by a separate cover 21 that is also adapted to the shape of the step 16 and to the shape of the inner face 12. The cover 21 has a first end tab 21*a* that is flush with the first offset face 17 and a second end tab 21*b* flush with the second face 18.

Basically an adaptation of the cover 21 to different frame geometries and in particular different heights of the step 16 may also be provided. In the simplest case, for different heights of the step 16, for example, different covers 21 may also be kept on hand as accessories. Furthermore, it is also possible for the cover 21 to be designed in multiple pieces in which case a front section is then adjustable with respect to a rear section. For this adjustment, for example, screws, a multistage catch connection or an adjustable oversize fit may be provided, for example.

According to FIG. 6, a small lateral gap remains between the door panel 2 and the first offset face 17. However, since the panel part 8 extends in part laterally from the door panel 2 according to FIGS. 3 through 5, the panel part 8 is situated exactly in the area of the gap between the door panel 2 and the first offset face 17. To achieve a uniform high quality appearance against this background, a screen 22 is attached to the panel part 8.

In order for the screen 22 to be flat and preferably without any gaps with respect to the front face 11 in the closed position of the door panel 2, the cutout 13 formed in the front face 11 is filled with a separate cover link 23 at its edge.

Figure 7:
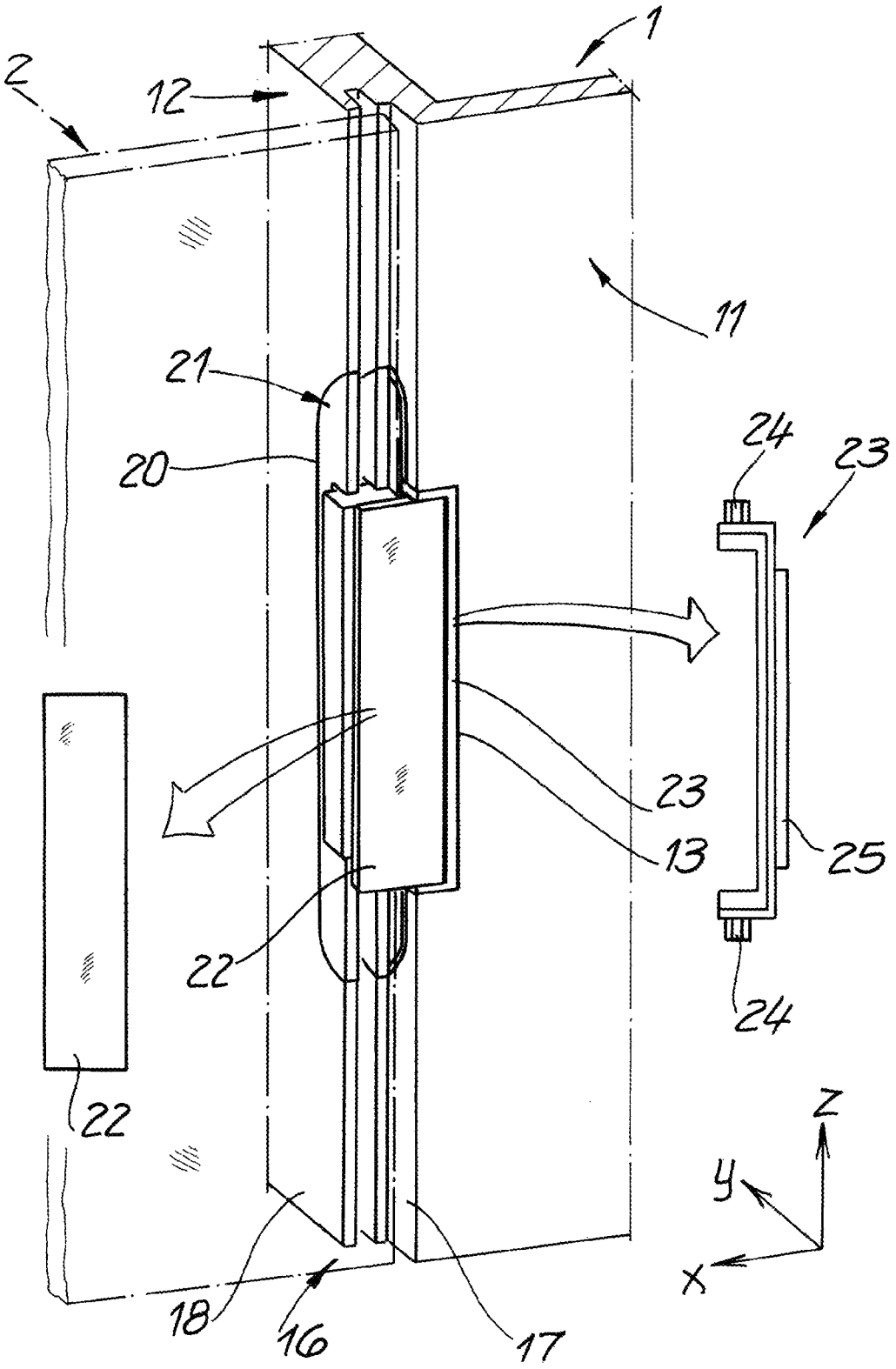
FIG. 7 is a view like FIG. 5 but showing some variants.

The screen 22 and the cover link 23 are illustrated in exploded form in FIG. 7. The cover link 23 can be arranged with a journal 24 on the end on the jamb part 7, so some mobility with respect to the panel part 8 is preferably still possible. For example, if the panel part 8 is adjustable along the vertical direction Z, then it is possible to ensure by mobility of the cover link 23 that the latter it always sits in the cutout 13 without any stresses.

To hold the cover link 23 securely in the cutout 13, it has a holding web 25 which can engage behind the front face 11. In addition, the cover link 23 forms a supporting surface for the screen 22. When the door panel is closed the screen 22 overlaps with the supporting surface of the holding link 23, so that a continuous gap is not visible and it gives the impression of a high quality closed surface.

FIGS. 8A through 8C illustrate the kinematics of the hinge 3 according to the invention in a purely schematic diagram, wherein due to the arrangement jamb axes 9*a*, 9*b* and the panel axes 10*a*, 10*b*, an opening angle of 180° is achieved.

In comparison with that, FIGS. 9A to 9C illustrate the kinematics of a cup hinge for furniture according to the prior art, as described in DE 43 41 422, for example. According to the requirements of a furniture hinge, a door panel 2' is first lifted by ultimately contrarotational movements on the two ends of the hinge links 4', 5' of a furniture body (not shown) and then rotated only up to angle of about 90°.

I claim:

1. A hinge mountable between a door jamb and an edge of a door panel, the hinge comprising:

a jamb part set in the jamb;

a panel part fixed to the panel;

a first link having one end pivoted at a first jamb axis in the jamb part and an opposite end pivoted at a first panel axis in the panel part; and a second link having one end pivoted at a second jamb axis in the jamb part offset from the first jamb axis and an opposite end pivoted at a second panel axis in the panel part, the axes all being substantially parallel and offset horizontally from one another such that the hinge can move from a closed position through an opening angle of at least 135° to a maximum open position with, during such opening from the closed position to the open position, the first and second links rotating in a first direction of rotation with respect to the jamb part and the panel part also rotating in the first direction of rotation with respect to the links, the links not being connected directly to one another between their ends, the first and second links being U-shaped in a center section between their ends, so that for the first link, starting from a first connecting line between the first panel axis and the first jamb axis, a greatest distance perpendicular to the first connecting line up to the center section, amounts to at least 0.5 times a distance between the first jamb axis and the first panel axis, and, starting from a second connecting line between the second panel axis and the second jamb axis, for the second link, a greatest distance perpendicular to the second connecting line up to the center section, amounts to at least 0.5 times the distance between the second jamb axis and the second panel axis.

2. The hinge defined in claim 1, the opening angle until reaching the maximum open position is between 170° and 185°.

3. The hinge defined in claim 1, wherein in that at least one of the links abuts against a stop face of the jamb part or of the panel part in the closed position or the open position.

4. The hinge defined in claim 3, wherein the second link abuts against a second stop face of the panel part in the closed position.

5. The hinge defined in claim 1, wherein in the closed position the panel part and the jamb part are side by side in a first horizontal direction, the first jamb axis and the second jamb axis are offset from one another along the first horizontal direction, and the first panel axis and the second panel axis are offset from one another along a second horizontal direction.

6. The hinge defined in claim 1, further comprising:

a clamp on the panel part for gripping the door panel.

7. The hinge defined in claim 1, wherein the door jamb has a front face aligned parallel with the door panel in the closed position of the hinge and also has an inner face at an edge to the door panel and extending perpendicular to the front face, the inner face having a first offset face starting from the front face and also has a second face connected thereto by a step.

8. The hinge defined in claim 7, wherein the door panel is of glass.

9. The hinge defined in claim 7, wherein the jamb part fits in a recess in the inner face and extends from the first offset face to the second face.

10. The hinge defined in claim 9, further comprising:

a separate cover provided with a step and on the jamb part, the cover having a first end tab of the cover connected to the first offset face so as to be flush therewith and a second end tab connected to the second face so as to be flush therewith.

11. The hinge defined in claim 10, wherein the front face has a cutout extending from the inner face at the hinge.

12. The hinge defined in claim 11, wherein the cutout is partially filled by a cover link arranged on the jamb part of the hinge.

13. The hinge defined in claim 12, further comprising:

a screen having an edge over the cover link and fitted to the panel part in the closed position.

14. A hinge mountable between a door jamb and an edge of a door panel, the hinge comprising:

a jamb part set in the jamb;

a panel part fixed to the panel;

a first link having one end pivoted at a first jamb axis in the jamb part and an opposite end pivoted at a first panel axis in the panel part; and a second link having one end pivoted at a second jamb axis in the jamb part offset from the first jamb axis and an opposite end pivoted at a second panel axis in the panel part, the axes all being substantially parallel and offset horizontally from one another such that the hinge can move from a closed position through an opening angle of at least 135° to a maximum open position with, during such opening from the closed position to the open position, the first and second links rotating in a first direction of rotation with respect to the jamb part and the panel part also rotating in the first direction of rotation with respect to the links, the links not being connected directly to one another between their ends, the first and second links being U-shaped in a center section between their ends, so that for the first link, starting from a first connecting line between the first panel axis and the first jamb axis, a greatest distance perpendicular to the first connecting line up to the center section, amounts to at least 0.5 times a distance between the first jamb axis and the first panel axis, and, starting from a second connecting line between the second panel axis and the second jamb axis, for the second link, a greatest distance perpendicular to the second connecting line up to the center section, amounts to at least 0.5 times the distance between the second jamb axis and the second panel axis, the first link abutting against a first stop face of the panel part in the maximum open position.

* * * * *